US006755629B2

(12) United States Patent
Utsumi

(10) Patent No.: US 6,755,629 B2
(45) Date of Patent: Jun. 29, 2004

(54) FUEL INJECTION PUMP HAVING ONE-WAY VALVE FOR SUPPLYING FUEL INTO PRESSURIZING CHAMBER

(75) Inventor: Yasutaka Utsumi, Kariya (JP)

(73) Assignee: Denso Corporation, Kariya (JP)

( * ) Notice: Subject to any disclaimer, the term of this patent is extended or adjusted under 35 U.S.C. 154(b) by 106 days.

(21) Appl. No.: 10/270,576

(22) Filed: Oct. 16, 2002

(65) Prior Publication Data

US 2003/0099563 A1 May 29, 2003

(30) Foreign Application Priority Data

Nov. 29, 2001 (JP) ..... 2001-364152

(51) Int. Cl.[7] ..... F04B 53/10
(52) U.S. Cl. ..... 417/454; 137/542; 251/337
(58) Field of Search ..... 137/15.17, 315.33, 137/542; 123/495; 251/337; 417/454, 470, 570

(56) References Cited

U.S. PATENT DOCUMENTS

| | | | | | |
|---|---|---|---|---|---|
| 760,309 | A | * | 5/1904 | Choiniere | 251/337 |
| 1,123,863 | A | * | 1/1915 | Flinn | 251/337 |
| 1,861,885 | A | * | 6/1932 | Sims | 251/337 |
| 2,467,060 | A | * | 4/1949 | Twitchell | 251/337 |
| 6,289,875 | B1 | * | 9/2001 | Shinohara et al. | 123/495 |

* cited by examiner

*Primary Examiner*—Michael Koczo
(74) *Attorney, Agent, or Firm*—Nixon & Vanderhye P.C.

(57) ABSTRACT

Low pressure fuel led from a fuel tank to a fuel injection pump is pressurized and sent out to a common rail that accumulates the pressurized fuel therein. A one-way valve that allows the low pressure fuel led from the fuel tank to flow into the fuel injection pump and prevents a fuel flow in a reverse direction is installed in the fuel injection pump. A supporting member for supporting a spring that biases a valve member in a direction to close the one-way valve is coupled to the valve member without using a rigid mechanical connection. The biasing force of the spring is received by a wide contacting surface of the supporting member, thereby reducing abrasion wear of the contacting surface.

7 Claims, 7 Drawing Sheets

FUEL INJECTION PUMP HAVING ONE-WAY VALVE FOR SUPPLYING FUEL INTO PRESSURIZING CHAMBER

CROSS-REFERENCE TO RELATED APPLICATION

This application is based upon and claims benefit of priority of Japanese Patent Application No. 2001-364152 filed on Nov. 29, 2001, the content of which is incorporated herein by reference.

BACKGROUND OF THE INVENTION

1. Field of the Invention

The present invention relates to a fuel injection pump having an one-way valve for supplying fuel into a pressurizing chamber and to a method of assembling the one-way valve.

2. Description of Related Art

A fuel injection system including a common rail and an injection pump for supplying pressurized fuel into an internal combustion engine is known hitherto. The fuel injection pump pressurizes fuel in a pressurizing chamber according to rotation of its driving shaft. Fuel pressurized to a predetermined level is sent out to the common rail from the pressurizing chamber. The injection pump includes a one-way valve that allows fuel to flow into the pressurizing chamber from a fuel tank while preventing fuel from flowing back into the fuel tank.

An example of a conventional one-way valve used in the fuel injection pump is shown in FIGS. 7A and 7B. A spring 102 is disposed between a valve body 101 and a valve member 100. The one-way valve is closed when the valve member 100 seats on a valve seat 103 formed on the valve body 101. The spring 102 biases the valve member 100 in a direction to close the one-way valve. To support the biasing spring 102 between the valve body 101 and the valve member 100, a ring-shaped washer 104 is provided at an upper end of the valve member 100. The upward movement of the washer 104 is restricted by an E-shaped ring 105 which is fixed to the valve member 100. Alternatively, the upward movement of the washer 104 is restricted by a stopper press-fitted to the valve member 100.

In a process of assembling the conventional one-way valve, the E-shaped ring 105 or the stopper has to be fixed to the valve member 100. Accordingly, a certain time is required in the assembling process for fixing the E-shaped ring 105 or the stopper. A contacting area between the E-shaped ring 105 and the valve member 100 is small as shown in FIG. 7B, and the biasing force of the spring 102 has to be received by the small contacting area. Therefore, the contacting area between the E-shaped ring 105 and the valve member 100, including portion where the washer 104 contacts the E-shaped ring 105, tends to wear due to abrasion during a long time operation of the one-way valve.

SUMMARY OF THE INVENTION

The present invention has been made in view of the above-mentioned problems, and an object of the present invention is to provide an improved one-way valve in which the abrasion wear is suppressed. Another object of the present invention is to provide an improved process of assembling the one-way valve.

A fuel injection pump driven by an automotive engine pressurizes low pressure fuel led from a fuel tank and sends out pressurized fuel to a common rail. The pressurized fuel accumulated in the common rail is injected form fuel injectors into the engine in a controlled manner. A one-way valve that allows fuel to flow only in one direction is installed in the fuel injection pump. The low pressure fuel led from the fuel tank flows into a pressurizing chamber in the fuel injection pump through the one-way valve. The pressurized fuel is prevented from flowing back by the one-way valve. The pressurized fuel is sent out to an outlet passage connected to the common rail.

The one-way valve is composed of a valve body, a valve member slidably coupled with the valve body, a biasing member such as a coil spring biasing the valve body in a direction to close the one-way valve, and a supporting member coupled to the valve member for supporting the biasing member between the valve body and the supporting member. The valve member is substantially rod-shaped and includes a head portion and a neck portion connected to the head portion, both of which serve to couple the supporting member to one end of the valve member. The supporting member is substantially disc-shaped. A through-hole and a groove, crossing each other, are formed in the supporting member.

In assembling the one-way valve, the valve member is slidably coupled to the valve body, and then a cylindrical portion of the valve member is inserted into the biasing member. Then, the head portion of the valve member is inserted into the through-hole of the supporting member, and the supporting member is further pushed down against the biasing member, so that the head portion is separated from the through-hole and the neck portion is positioned in the through-hole. Then, the supporting member is rotated relative to the valve member so that the groove formed on the supporting member is aligned to the head portion of the valve member. Because the neck portion is made smaller than the through-hole, the neck portion is freely rotatable in the through-hole. Then, the force pushing down the supporting member against the biasing member is released thereby to engage the head portion with the groove. The head portion is retained in the groove, while the biasing force being applied between the valve member and the valve body. Thus, the process of assembling the one-way valve is completed.

According to the present invention, abrasion wear in the one-way valve is suppressed because the biasing force of the spring is received by the supporting member having a wide surface. The assembling process of the one-way valve is simplified because the supporting member and the valve member are coupled to each other without using a mechanical connection such as staking.

Other objects and features of the present invention will become more readily apparent from a better understanding of the preferred embodiment described below with reference to the following drawings.

DETAILED DESCRIPTION OF THE PREFERRED EMBODIMENT

Figure 2:
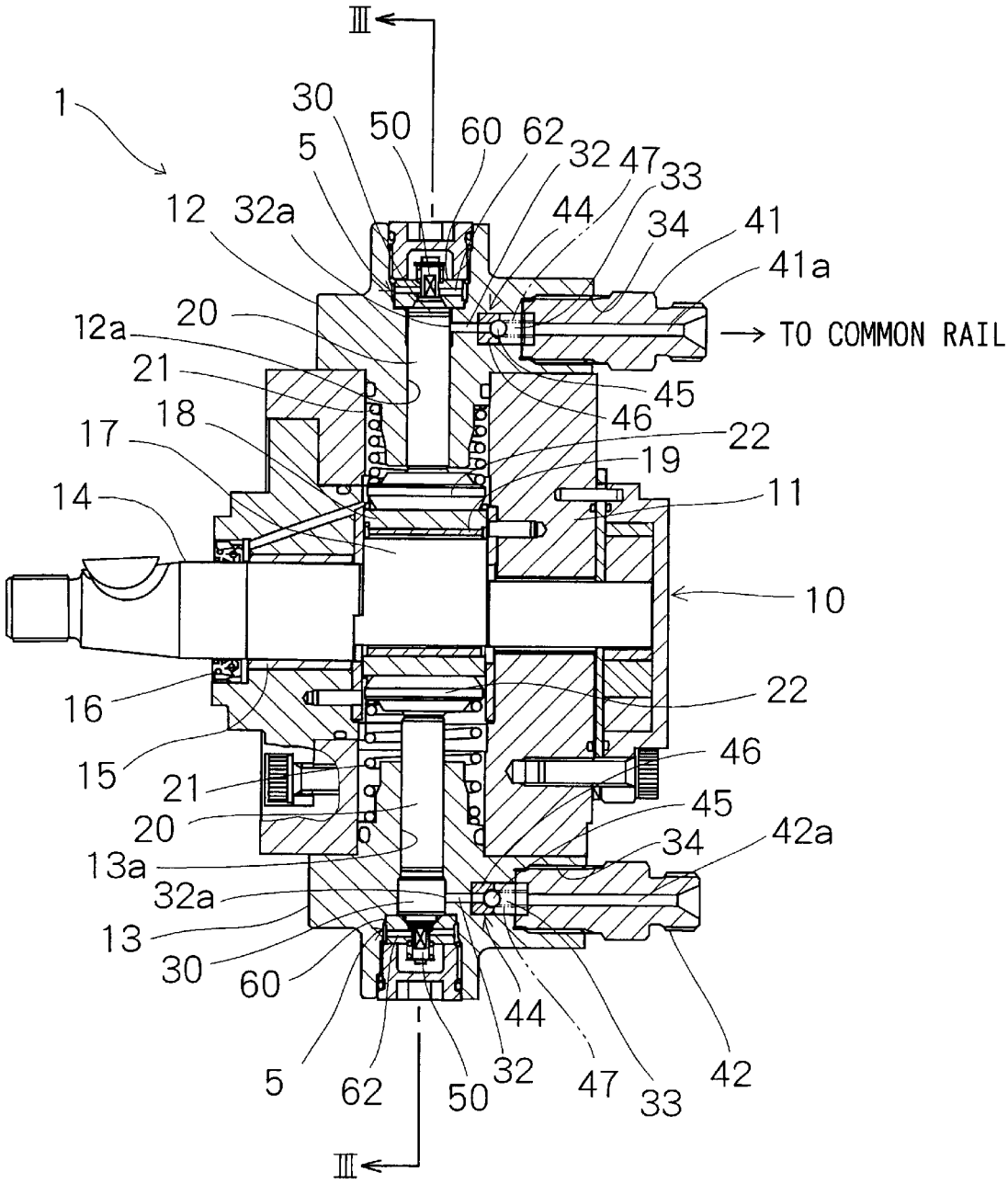
FIG. 2 is a cross-sectional view showing an entire structure of a fuel injection pump in which the one-way valve is used.

A preferred embodiment of the present invention will be described with reference to the accompanying drawings. First, referring to FIGS. 2 and 3, an entire structure of a fuel injection pump 1 will be described. The fuel injection pump 1 is used in a fuel injection system having a common rail accumulating pressurized fuel therein.

A housing 10 of the fuel injection pump 1 is composed of a housing body 11 and a pair of cylinder heads 12, 13. The housing body 11 is made of aluminum, and the cylinder heads 12, 13 are made of iron. A cylinder 12*a*, in which a plunger 20 is slidably disposed, is formed in the cylinder head 12. Similarly, a cylinder 13*a*, in which a plunger 20 is slidably disposed, is formed in the cylinder head 13. A one-way valve 5 is installed at an outside portion of each cylinder 12*a*, 13*a*. A pressurizing chamber 30 is formed in each cylinder 12*a*, 13*a* between the plunger 20 and the one-way valve 5. In this embodiment, both cylinder heads 12, 13 are formed in a similar shape, but positions of fuel passages and screw holes formed therein are little different from each other. Both cylinder heads 12, 13, however, may be formed in an exactly same shape.

Figure 3:
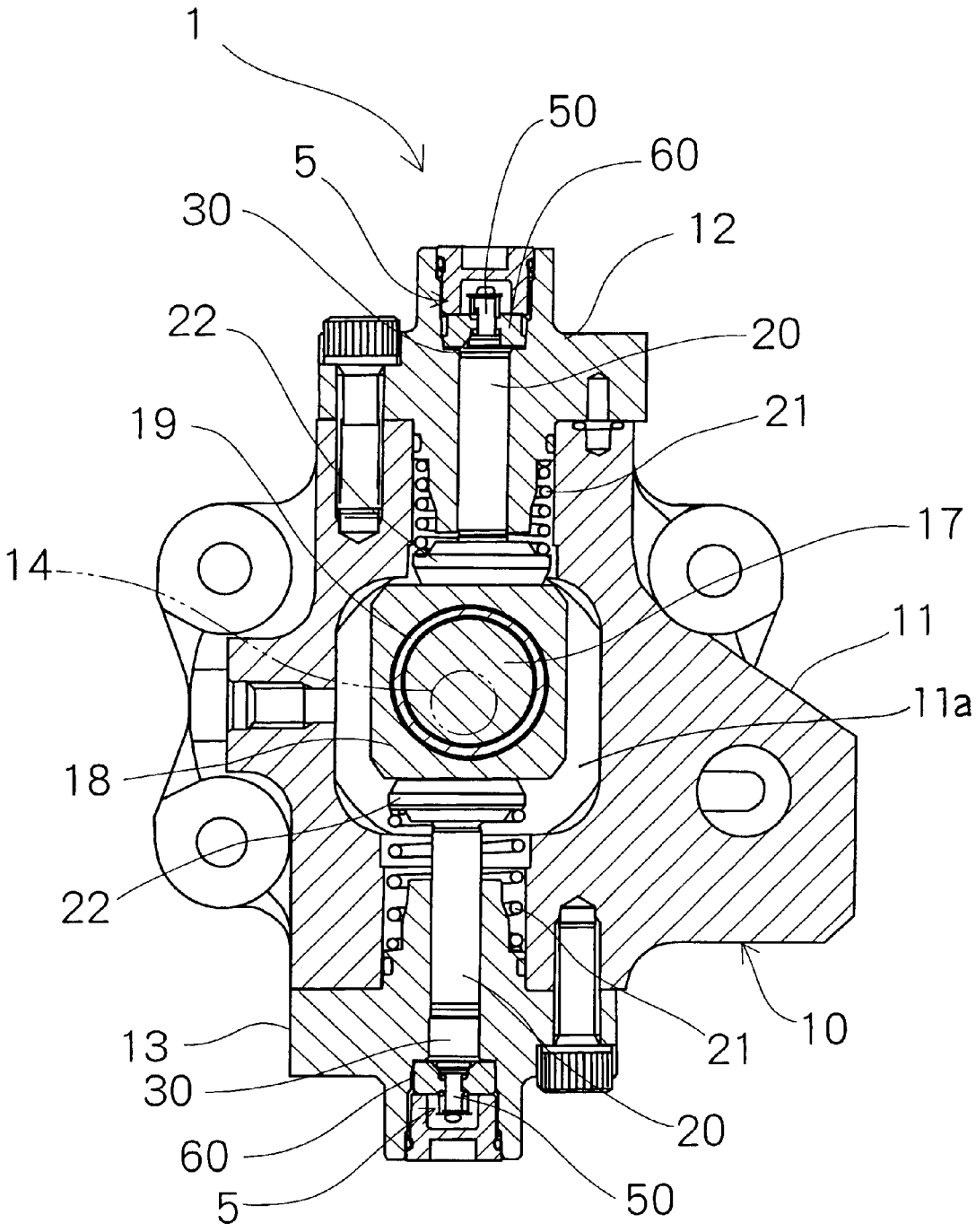
FIG. 3 is a cross-sectional view showing the fuel injection pump, taken along a line III—III shown in FIG. 2.

A driving shaft 14 is rotatably supported by the housing body 11 via a journal bearing 15. A clearance between the driving shaft 14 and the housing body 11 is sealed by an oil seal 16. As shown in FIG. 3, a cam 17 having a cylindrical outer periphery is formed on the driving shaft 14 in an eccentric relation to a rotational axis of the driving shaft 14. The pair of plungers 20 are disposed in the respective cylinders 12*a*, 13*a* at positions, 180-degree opposing to each other. A cam ring 18 having a square outer periphery is rotatably coupled to the cam 17, and a bushing 19 is interposed as a bearing between the cam 17 and the cam ring 18. A plunger head 22 formed at one end of the plunger 20 slidably contacts one plane of the square outer periphery of the cam ring 18. An inner space 11*a* of the housing body 11 is filled with fuel such as light oil, and the contacting surface between the plunger head 22 and the cam ring 18 is lubricated by the fuel.

The pair of plungers 20 are reciprocally driven in the respective cylinders 12*a*, 13*a* according to rotation of the eccentric cam 17. Fuel is sucked into the pressuring chamber 30 through the one-way valve 5 and pressurized therein. A spring 21 biases the plunger 20 toward the cam ring 18. The cam ring 18 orbits around the eccentric cam 17 without rotating by itself according to the rotation of the driving shaft 14, and thereby the plunger head 22 slidably moves on the plane surface of the cam ring 18. Thus, the plunger 20 is reciprocally driven by the cam ring 18. An outlet passage 32 extending in a direction perpendicular to each cylinder 12*a*, 13*a* is formed, so that it connects an outlet port 32*a* of the pressurizing chamber 30 to respective fuel passages 41*a*, 42*a* formed in connecting members 41, 42.

A fuel chamber 33 is formed in each cylinder head 12, 13 and is connected to the outlet port 32*a* through the outlet passage 32. The fuel changer 33 is formed in a cylinder-shape having a diameter larger than that of the outlet passage 32. An outlet one-way valve 44 is disposed in the fuel chamber 33. Connecting members 41, 42 are screwed in respective mounting holes 34 formed in each cylinder head 12, 13 at a downstream end of the fuel chamber 33. Fuel passages 41*a*, 42*a* each communicating with the fuel chamber 33 are formed in the respective connecting members 41, 42. The respective fuel passages 41*a*, 42*a* extend substantially in line with the outlet passage 32.

The outlet one-way valve 44 disposed in the fuel chamber 33 is composed of a ball-shaped valve member 45, a valve body 46 and a spring 47. The spring 47 biases the valve member 45 toward the valve body 46. The outlet one-way valve 44 allows the pressurized fuel to flow out of the pressurizing chamber 30 and prevents the fuel from flowing back into the pressurizing chamber 30. The connecting members 41, 42 are connected to the common rail (not shown) through fuel pipes (not shown). Thus, the fuel pressurized in the pressurizing chamber 30 is supplied to the common rail.

Now, referring to FIGS. 1A–1B, 4A–4C and 5A–5B, a structure of the one-way valve 5 will be described in detail. As described above, the one-way valve 5 is disposed outside the pressurizing chamber 30 in each cylinder head 12, 13. The one-way valve 5 is composed of a valve body 60, a valve member 50, a supporting member 80, and a spring 70. The valve member 50 is substantially rod-shaped and includes a head portion 51, a neck portion 52, a cylindrical portion 53, and a flange portion 54, all integrally formed in this order from its top side.

Figure 4A:
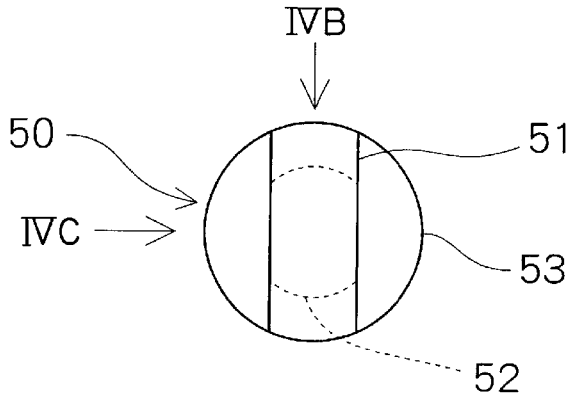
FIG. 4A is a top view showing a valve member used in the one-way valve.
Figure 4B:
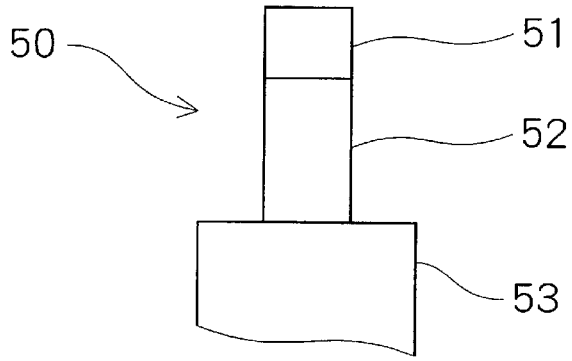
FIG. 4B is a side view showing the valve member, viewed in a direction IVB shown in FIG. 4A.
Figure 4C:
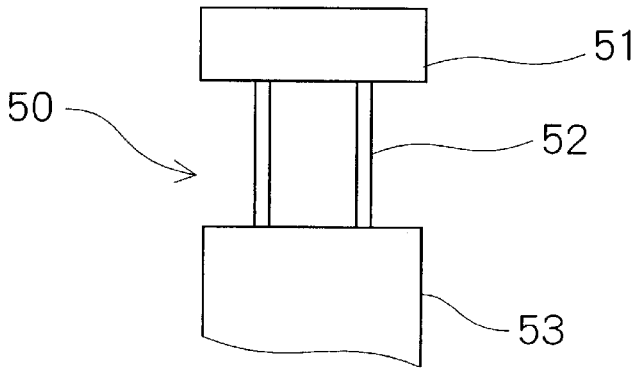
FIG. 4C is another side view showing the valve member, viewed in a direction IVC shown in FIG. 4A.

The head portion 51 is formed substantially in a rectangular rod shape, as shown in FIGS. 4A–4C. The head portion 51 is connected to the cylindrical portion 53 by the neck portion 52 extending in an axial direction of the cylindrical portion 53. A top surface of the head portion 51 is a substantially rectangular shape, as shown in FIG. 4A, having a pair of straight long sides parallel to each other and a pair of circular short sides. The head portion 51 is connected to the cylindrical portion 53 by the neck portion 52. As shown in FIG. 4A, a cross-sectional shape of the neck portion 52 on a plane perpendicular to the longitudinal axis of the valve member 50 has a pair of straight long sides and a pair of circular short sides. As shown in FIG. 4B, a width between the long sides of the neck portion 52 is the same as that of the head portion 51. As shown in FIG. 4C, a dimension between the circular sides of the neck portion 52 is shorter than that of the head portion 51.

Figure 1A:
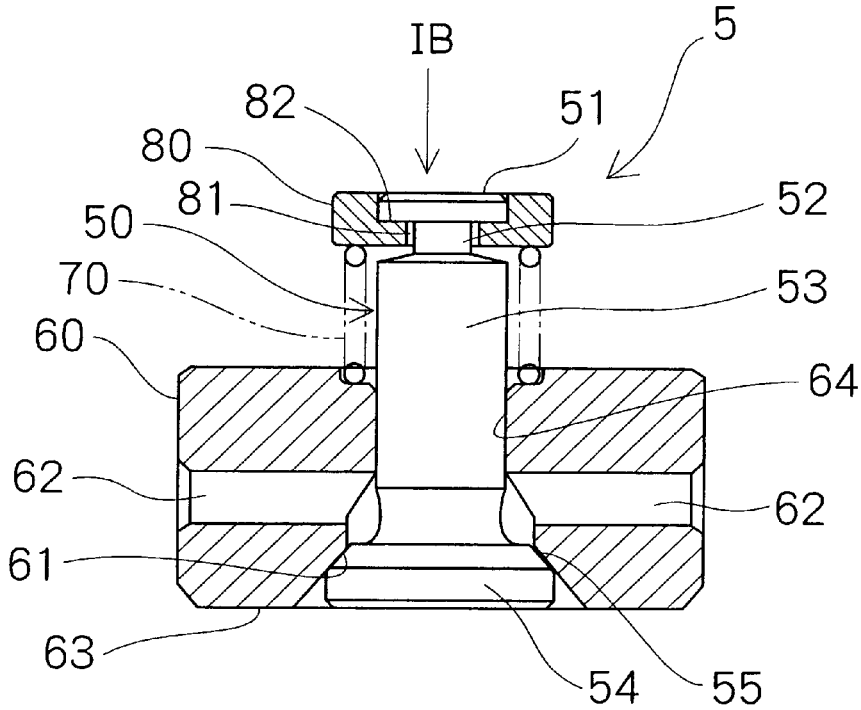
FIG. 1A is a cross-sectional view showing a one-way valve according to the present invention.
Figure 1B:
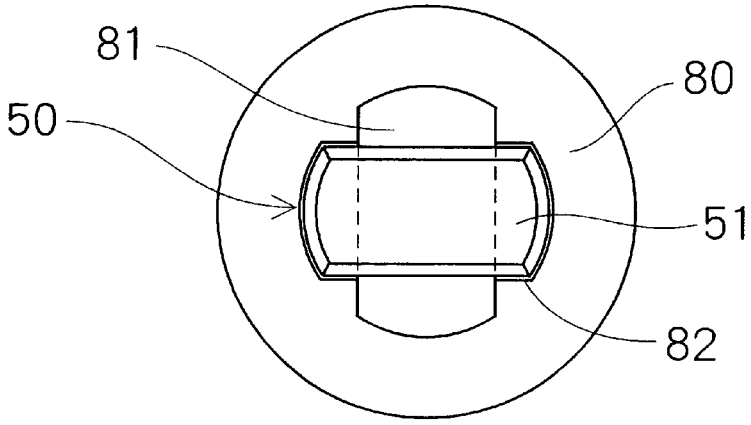
FIG. 1B is a plan view showing the one-way valve, viewed in a direction IB shown in FIG. 1A.

As shown in FIG. 1A, the flange portion 54 having a diameter larger than a diameter of the cylindrical portion 53 is formed at the bottom end of the valve member 50. The flange portion 54 is disc-shaped and has a valve surface 55 that contacts a valve seat 61 formed on the valve body 60. The cylindrical portion 53 slidably inserted in an inner bore 64 of the valve body 60.

The valve body 60 includes a fuel passage 62 that communicates with a fuel supply pump through a fuel supply passage (not shown) formed in each cylinder head 12, 13. A bottom surface 63 of the valve body 60 faces the pressurizing chamber 30 thereby forming one end surface of the pressurizing chamber 30. The inner bore 64 into which the valve member 50 is slidably inserted is formed in the valve body 60 in a direction perpendicular to the fuel passage 62. The valve seat 61 is formed at a corner of a bottom opening of the valve body 60. When the valve member 50 is reciprocally driven in the inner bore 64 of the valve body 60, the valve surface 55 contacts the valve seat 61 or separated therefrom. As shown in FIG. 1A, the supporting member 80 is coupled to the upper end of the valve member 50 in a manner described later. The coil spring 70 is disposed between the supporting member 80 and the valve body 60 in a compressed manner, so that a biasing force of the spring 70 is applied to the valve member 50 in a direction to establish contact between the valve surface 55 and the valve seat 61.

Figure 5A:
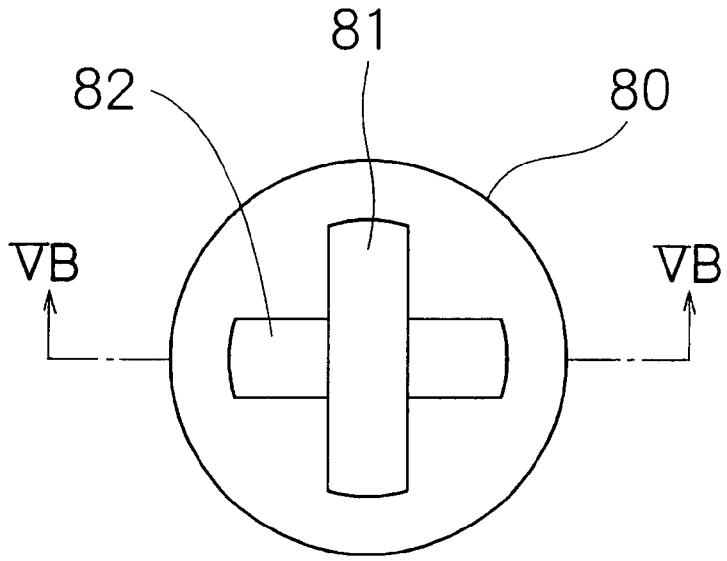
FIG. 5A is a top view showing a supporting member to be coupled with the valve member.
Figure 5B:
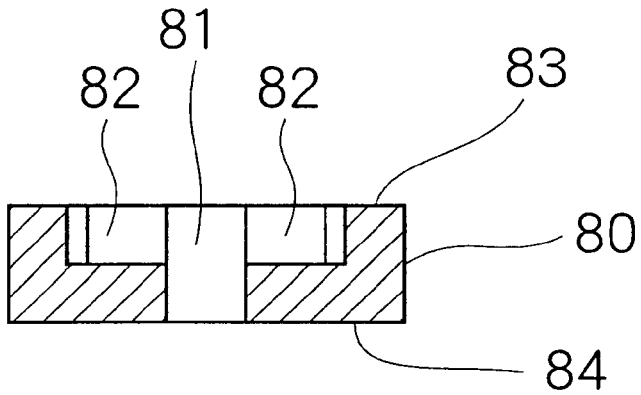
FIG. 5B is a cross-sectional view showing the supporting member, taken along a line VB—VB shown in FIG. 5A.

As shown in FIGS. 5A and 5B, the supporting member 80 is substantially disc-shaped. A through-hole 81 is formed through the supporting member 80 from its upper surface 83 to its bottom surface 84, and a groove 82 is formed on the supporting member 80. The shape of the through-hole 81 corresponds to the shape of the head portion 51 of the valve member 50, and is made a little larger than that of the head portion 51 so that the head portion 51 is freely inserted into the through-hole 81. The groove 82 is formed on the supporting member 80 crossing the through-hole 81. The depth of the groove 82 is substantially the same as the thickness (a longitudinal dimension) of the head portion 51, and its plane shape is the same as that of the through-hole 81, so that the head portion 51 is retained in the groove 82. The width of the through-hole 81 is made larger than the outermost diameter of the neck portion 52, so that the neck portion is freely rotatable in the through-hole 81 when the neck portion 52 is inserted into the through-hole 81 in a manner described below.

Figure 6A:
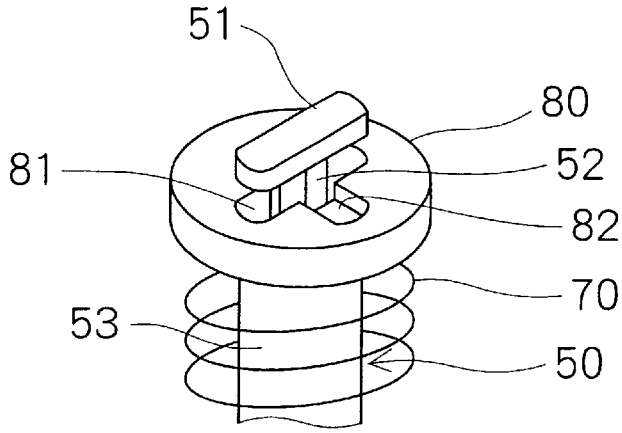
FIGS. 6A–6C show a process of assembling the one-way valve according to the present invention.

Now, referring to FIGS. 6A–6C, a method of assembling the one-way valve 5 will be described. First, the valve member 50 is slidably inserted into the inner bore 64 of the valve body 60. Then, as shown in FIG. 6A, an upper portion of the cylindrical portion 53 of the valve member 50 is inserted into the coil spring 70. The head portion 51 of the valve member 50 is inserted through the through-hole 81 of the supporting member 80. Then, the supporting member 80 is pushed down against the spring force of the coil spring 70. Thus, the supporting member 80 is positioned at the neck portion 52 of the valve member 50.

Figure 6B:
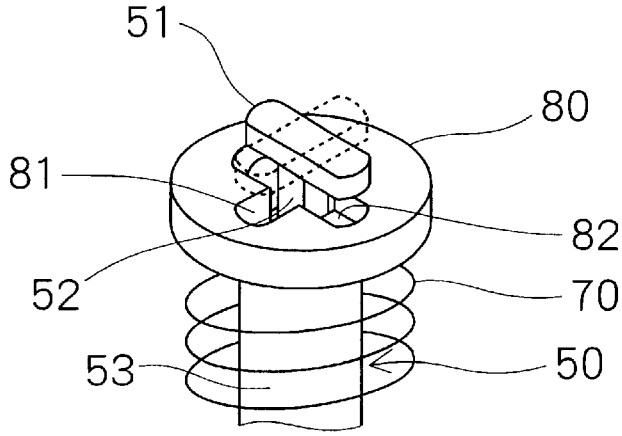

Then, as shown in FIG. 6B, the valve member 50 is rotated relative to the supporting member 80 (the supporting member 80 may be rotated) to an angular position where the head portion 52 aligns with the groove 82. Since the size of the neck portion 52 is smaller than that of the through-hole 81, the neck portion can be freely rotated in the through-hole 81. Then, as shown in FIG. 6C, the force pushing down the supporting member 80 against the spring 70 is released, thereby making the head portion 52 engage with the groove 82. Thus, the relative rotation between the supporting member 80 and the valve member 50 is restricted. Since the supporting member 80 is pushed up by the spring 70, a downward movement of the supporting member 80 is restricted. In this manner, the supporting member 80 is coupled to the upper end of the valve member 50, and the assembling process of the one-way valve 5 is completed.

Operation of the fuel injection pump 1 will be briefly described. According to rotation of the driving shaft 14, the eccentric cam 17 is rotated. The cam ring 18 coupled to the cam 17 is driven eccentrically with respect to the axis of the driving shaft 14. The plunger 20 in each cylinder 12*a*, 13*a* is reciprocally driven. As the plunger 20 is driven from a top dead center toward a bottom dead center, the inner space of the pressurizing chamber 30 is enlarged, and the pressure therein is decreased. The one-way valve 5 is opened against the basing force of the spring 70 by the negative pressure in the pressuring chamber 30 and a fuel pressure led from the fuel tank. Thus, the fuel is sucked into the pressuring chamber 30 according to the stroke of the plunger 20 toward the bottom dead center.

Then, the plunger 20 is driven from the bottom dead center toward the top dead center, and thereby the pressuring chamber 30 is pressurized and the one-way valve 5 is closed by the pressure in the pressurizing chamber 30. When the fuel pressure in the pressurizing chamber 30 becomes higher than a pressure in the fuel chamber 33 connected to the pressurizing chamber 30 through the outlet passage 32, the outlet one-way valve 44 is opened. The pressurized fuel is supplied from the pressurizing chamber 30 to the common rail (not shown). The fuel pressurized in both cylinders 12*a*, 13*a* is supplied to the common rail together.

The pressurized fuel supplied from the fuel injection pump 1 in a pulsating manner is accumulated in the common rail as fuel having a constant pressure. The fuel accumulated in the common rail is supplied to fuel injectors (not shown) which inject the fuel into the engine in a controlled manner.

Advantages of the present invention described above will be summarized. The supporting member 80 is simply coupled to the upper portion of the valve member 50 by engaging the head portion 51 with the groove 82. The spring 70 is supported and held between the valve body 60 and the supporting member 80. In other words, the supporting member 80 is coupled to the valve member 50 without performing a staking process or the like. Therefore, the washer and the E-shaped ring or other fixing parts used in the conventional one-way valve can be eliminated, and the process of assembling the one-way valve 5 is simplified.

The biasing force of the spring 70 is received by the bottom surface 84 of the supporting member 80. Since the area of the bottom surface 84 is sufficiently large, abrasion wear of the supporting member 80 is prevented or suppressed. Therefore, the one-way valve 5 and the fuel injection pump 1 having such one-way valve can be used for a long time. Further, since the supporting member 80 is coupled to the valve member 50 by engaging the head portion 51 of the valve member with the groove 82 of the supporting member, the biasing force of the spring 70 applied to the supporting member 80 is received by the head portion 51 having a sufficiently large area. Therefore, abrasion wear occurring on the contacting surfaces of the head portion 51 of the valve member 5 and the groove 82 of the supporting member 80 can be reduced.

Figure 6C:
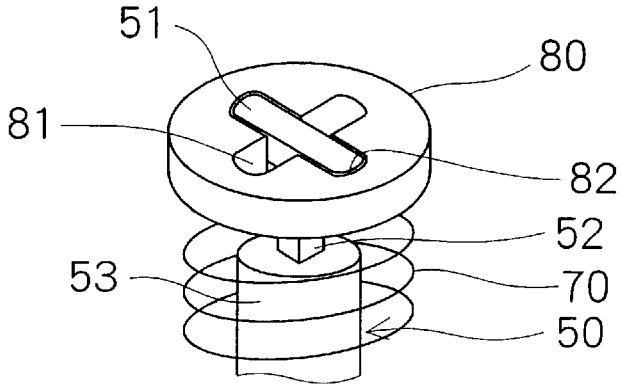
Figure 7A:
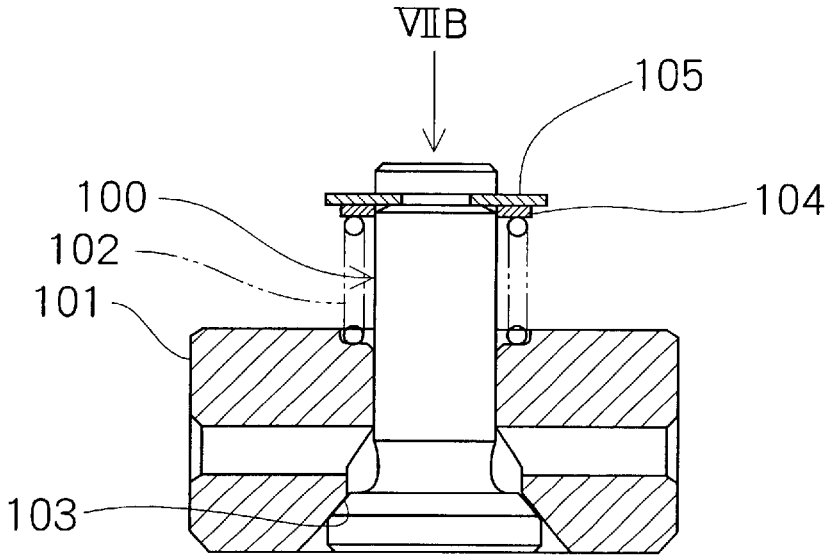
FIG. 7A PRIOR ART
FIG. 7A is a cross-sectional view showing a conventional one-way valve.
Figure 7B:
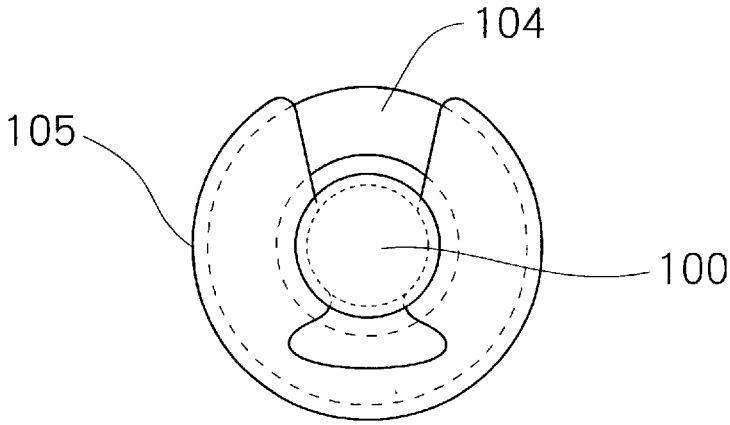
FIG. 7B PRIOR ART
FIG. 7B is a top view showing a washer and an E-shaped ring used in the conventional one-way valve, viewed in a direction VIIB shown in FIG. 7A.

Further, since the head portion 51 is retained in the groove 82 so that the upper surface of the head portion 51 becomes substantially equal level to the upper surface 83 of the supporting member 80, as shown in FIG. 6C, the head portion 51 is prevented from being damaged.

The present invention is not limited to the embodiment described above, but it may be variously modified. For example, the head portion 51 may be formed in other shapes such as a rectangular or half-circle shape. Though the groove 82 is formed to cross the through-hole 81 with a right angle in the foregoing embodiment, the groove 82 may be formed to cross the through-hole 81 with an appropriate angle.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A fuel injection pump for pressurizing fuel in a pressurizing chamber and for supplying pressurized fuel to a common rail, the fuel injection pump including a one-way valve that allows fuel to flow into the pressurizing chamber and prevents fuel from flowing out of the pressurizing chamber, the one-way valve comprising:

a valve body having a valve seat;

a valve member having a valve surface adapted to seat on the valve seat, the one-way valve being closed when the valve surface seats on the valve seat and being opened when the valve surface is separated from the valve seat;

a biasing member biasing the valve member in a direction to close the one-way valve; and a supporting member for supporting the biasing member between the valve body and the valve member, wherein:

the valve member includes a flange portion formed at one end of the valve member, a cylindrical portion connected to the flange portion, a head portion formed at the other end of the valve member, and a neck portion connecting the head portion to the cylindrical portion;

the supporting member includes a through-hole, in which the neck portion is rotatable when the head portion and the neck portion are inserted into the through-hole, and a groove formed on the supporting member crossing the through-hole; and the head portion engages with the groove thereby to couple the supporting member to the valve member.

2. The fuel injection pump as in claim 1, wherein:

the groove is formed in a substantially same shape as the head portion.

3. The fuel injection pump as in claim 2, wherein:

a depth of the groove is substantially the same as a thickness of the head portion, so that an upper surface of the head portion comes to a level equal to an upper surface of the supporting member when the head portion is retained in the groove.

4. The fuel injection pump as in claim 1, wherein:

the head portion is formed substantially in a rod-shape which extends in a direction perpendicular to the neck portion.

5. The fuel injection pump as in claim 1, wherein:

the groove has a plane shape, viewed in a an axial direction of the valve member, which is substantially the same as a plane shape of the through-hole.

6. The fuel injection pump as in claim 5, wherein:

the through-hole and the groove are formed to cross each other with a substantially right angle.

7. A method of assembling the one-way valve defined in claim 1, the method comprising:

coupling the valve body with the valve member;

inserting the cylindrical portion of the valve member into the biasing member;

inserting the head portion of the valve member into the through-hole of the supporting member so that the supporting member abuts the biasing member;

pushing down the supporting member against the biasing member until the head portion is separated from the through-hole and the neck portion is positioned in the through-hole;

rotating the supporting member relative to the head portion to a position where the groove of the supporting member aligns with the head portion; and releasing a force pushing down the supporting member against the biasing member so that the head portion is engaged with the groove and retained therein.

* * * * *